US009914619B2

(12) United States Patent
Roberts et al.

(10) Patent No.: US 9,914,619 B2
(45) Date of Patent: Mar. 13, 2018

(54) ELEVATOR ROPE SWAY MITIGATION

(75) Inventors: Randall Keith Roberts, Hebron, CT (US); George Scott Copeland, Wethersfield, CT (US); Theresa M. Christy, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 617 days.

(21) Appl. No.: 14/405,654

(22) PCT Filed: Jun. 4, 2012

(86) PCT No.: PCT/US2012/040688
§ 371 (c)(1),
(2), (4) Date: Jan. 12, 2015

(87) PCT Pub. No.: WO2013/184085
PCT Pub. Date: Dec. 12, 2013

(65) Prior Publication Data

US 2015/0166304 A1 Jun. 18, 2015

(51) Int. Cl.

| | |
|---|---|
| ***B66B 5/02*** | (2006.01) |
| ***B66B 1/28*** | (2006.01) |
| ***B66B 5/00*** | (2006.01) |

(52) U.S. Cl.
CPC ..... *B66B 5/022* (2013.01); *B66B 1/28* (2013.01); *B66B 5/0031* (2013.01)

(58) Field of Classification Search
CPC ..... B66B 5/02; B66B 1/28; B66B 5/00312
USPC ..... 187/247, 277, 278, 380–388, 391, 393
See application file for complete search history.

(56) References Cited

U.S. PATENT DOCUMENTS

| | | | | |
|---|---|---|---|---|
| 4,643,276 | A * | 2/1987 | Philobos | B66B 5/022 187/278 |
| 7,681,696 | B2 * | 3/2010 | Yamagishi | B66B 5/022 187/313 |
| 7,784,590 | B2 * | 8/2010 | Watanabe | B66B 5/022 187/388 |
| 7,905,329 | B2 * | 3/2011 | Urata | B66B 5/022 187/278 |
| 7,909,144 | B2 * | 3/2011 | Fukui | B66B 5/02 187/292 |

(Continued)

FOREIGN PATENT DOCUMENTS

| | | |
|---|---|---|
| CN | 101146731 A | 3/2008 |
| CN | 101213139 A | 7/2008 |

(Continued)

OTHER PUBLICATIONS

State Intellectual Property Office of People's Republic China Search Report; Application No. 201280073726.7; dated Nov. 19, 2015; 3 pages.
International Preliminary Report on Patentability; PCT/US2012/040688; dated Dec. 9, 2014; 5 pages.
International Search Report of the International Searching Authority; PCT/US2012/040688; dated Jan. 21, 2013; 5 pages.
Written Opinion of the International Searching Authority; PCT/US2012/040688; dated Jan. 21, 2013; 4 pages.

*Primary Examiner* — Anthony Salata
(74) *Attorney, Agent, or Firm* — Cantor Colburn LLP

(57) ABSTRACT

A method of operating an elevator system includes detecting a building sway which causes sway of elevator suspension or compensation members. An elevator control system is switched into a building sway mode, and operation of one or more elevator cars of the elevator system is changed via the building sway mode to mitigate vibratory effects of the building sway on the one or more elevator cars.

8 Claims, 5 Drawing Sheets

(56) References Cited

U.S. PATENT DOCUMENTS

| | | | | |
|---|---|---|---|---|
| 7,926,620 | B2 * | 4/2011 | Amano | B66B 5/022 187/278 |
| 8,123,002 | B2 * | 2/2012 | Smith | B66B 1/42 187/266 |
| 8,297,412 | B2 * | 10/2012 | Roberts | B66B 1/2416 187/292 |
| 8,579,089 | B2 * | 11/2013 | Hakala | B66B 1/24 187/278 |
| 8,800,722 | B2 * | 8/2014 | Kodera | B66B 5/021 187/278 |
| 9,415,972 | B2 * | 8/2016 | Tanaka | B66B 1/28 |
| 9,475,674 | B2 * | 10/2016 | Benosman | B66B 7/06 |
| 9,546,073 | B2 * | 1/2017 | Roberts | B66B 5/022 |
| 2010/0140023 | A1 | 6/2010 | Fukui et al. | |
| 2010/0314202 | A1 | 12/2010 | Roberts et al. | |

FOREIGN PATENT DOCUMENTS

| | | | |
|---|---|---|---|
| CN | 101287669 | A | 10/2008 |
| CN | 101663220 | A | 3/2010 |
| CN | 101977835 | A | 2/2011 |
| JP | 5319720 | A | 12/1993 |
| JP | 2003104656 | A | 4/2003 |
| JP | 2006232447 | A | 9/2006 |
| JP | 2012101899 | A | 5/2012 |
| WO | 2007013434 | A1 | 2/2007 |

* cited by examiner

ELEVATOR ROPE SWAY MITIGATION

BACKGROUND OF THE INVENTION

The subject matter disclosed herein relates to elevator systems. More specifically, the subject matter disclosed herein relates to mitigation of sway of suspension and/or driving ropes for elevator systems.

Elevator systems typically include one or more ropes or other suspension members from which an elevator car is suspended, and with which the elevator car is driven along a hoistway. Tall buildings in particular, which have elevator systems servicing them, have some sway associated with them. This sway, most often experienced during periods of high winds, can seriously impact elevator performance and, in some instances, damage elevator components. For example, building sway can result in rope sway that, especially when the rope length is shortened as the car runs into an upper or lower landing, has a significant lateral amplitude that causes excessive vertical vibration and noise at the elevator car. Further, rope sway effects experienced at the elevator car are increased at certain floors where the rope sway frequency is at or near the building sway vibratory frequency.

The typical approach to rope sway mitigation involves deploying mechanical elements such as sway arms, snubbing devices, car followers, rope guides, isolators or the like. The mechanical elements such as the above increase system cost and many times lack the reliability necessary to prevent the effects of rope sway. Another solution includes adjusting a tie down sheave in the hoistway to minimize the effect of compensation rope sway during the high wind event. The building is then monitored for sway and wind modes are implemented limiting elevator performance, for example, stopping service to floors in a predetermined "critical zone", at which the effects of the building sway on the elevator car are greatest. This approach, however, results in having many unserviceable floors of the building during building sway events, which is unacceptable to many elevator system users.

BRIEF DESCRIPTION OF THE INVENTION

According to one aspect of the invention, a method of operating an elevator system includes detecting a building sway which causes sway of elevator suspension or compensation members. An elevator control system is switched into a building sway mode, and operation of one or more elevator cars of the elevator system is changed via the building sway mode to mitigate vibratory effects of the building sway on one or more elevator cars.

Alternatively in this or other aspects of the invention, changing operation of one or more elevator cars includes stopping an elevator car during travel to reduce a sway amplitude of suspension or compensation members operably connected to the elevator car via the stoppage. Movement of the elevator car is then restarted.

Alternatively in this or other aspects of the invention, a false call is assigned to the elevator car to stop the elevator car.

Alternatively in this or other aspects of the invention, the elevator car is given priority for a call at an intermediate floor to stop the elevator car.

Alternatively in this or other aspects of the invention, changing operation of the one or more elevator cars includes limiting a continuous length of time an elevator car may spend at a floor or number of floors defined as a critical zone with regard to suspension or compensation member sway by configuring individual elevator cars of the elevator system with critical zones at different levels in the building. The controller is utilized to direct passengers to selected elevator cars such that a destination of each passenger is not within the critical zone for the elevator car to which they are assigned, thereby limiting continuous time of the elevator cars in their respective critical zones.

Alternatively in this or other aspects of the invention, the critical zones are configured by installing different tie down sheaves at each elevator car.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
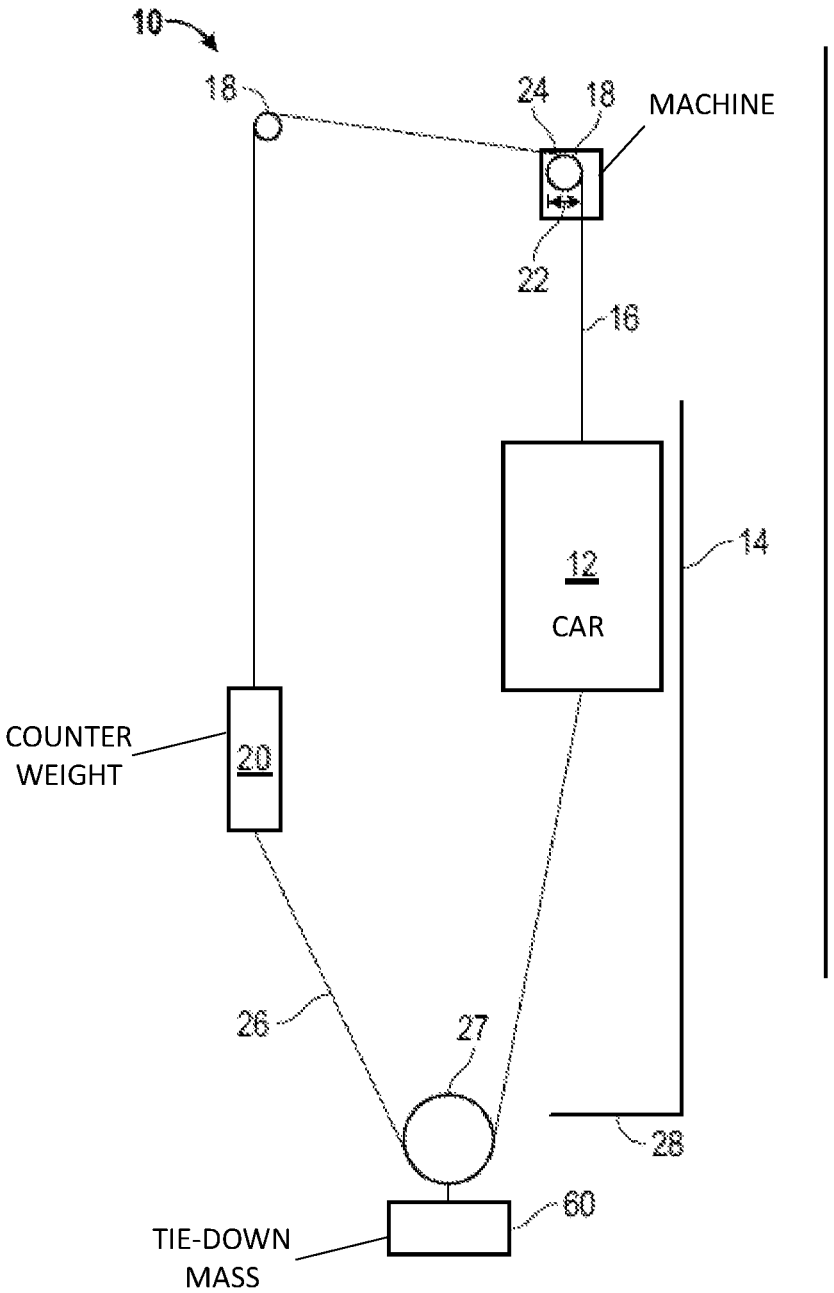
FIG. 1 is an illustration of an embodiment of an elevator system.

Shown in FIG. 1 is an embodiment of an elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more suspension members, for example, suspension ropes 16. The one or more suspension ropes 16 interact with one or more sheaves 18 to be routed around various components of the elevator system 10. The one or more suspension ropes 16 are also connected to a counterweight 20, which is used to help balance the elevator system 10 and reduce the difference in rope tension on both sides of the one or more sheaves 18 during operation. The sheaves 18 each have a diameter 22, which may be the same or different than the diameters of the other sheaves 18 in the elevator system 10. At least one of the sheaves 18 could be a drive sheave driven by a machine 24. Movement of the drive sheave by the machine 24 drives, moves and/or propels (through traction) the one or more suspension ropes 16 that are routed around the drive sheave 18 thereby moving the elevator car 12 along the hoistway 14. The elevator system 10 may further include one or more compensation ropes 26 extending from the elevator car 12 toward a hoistway pit 28 around a compensation sheave 27 and up to the counterweight 20. A tie-down mass 60 may be disposed in the hoistway pit 28 and affixed to the compensation sheave 27. The compensation ropes 26, compensation sheave 27 and tie-down mass 60 stabilize motion of the elevator car 12 along the hoistway 14.

Figure 2:
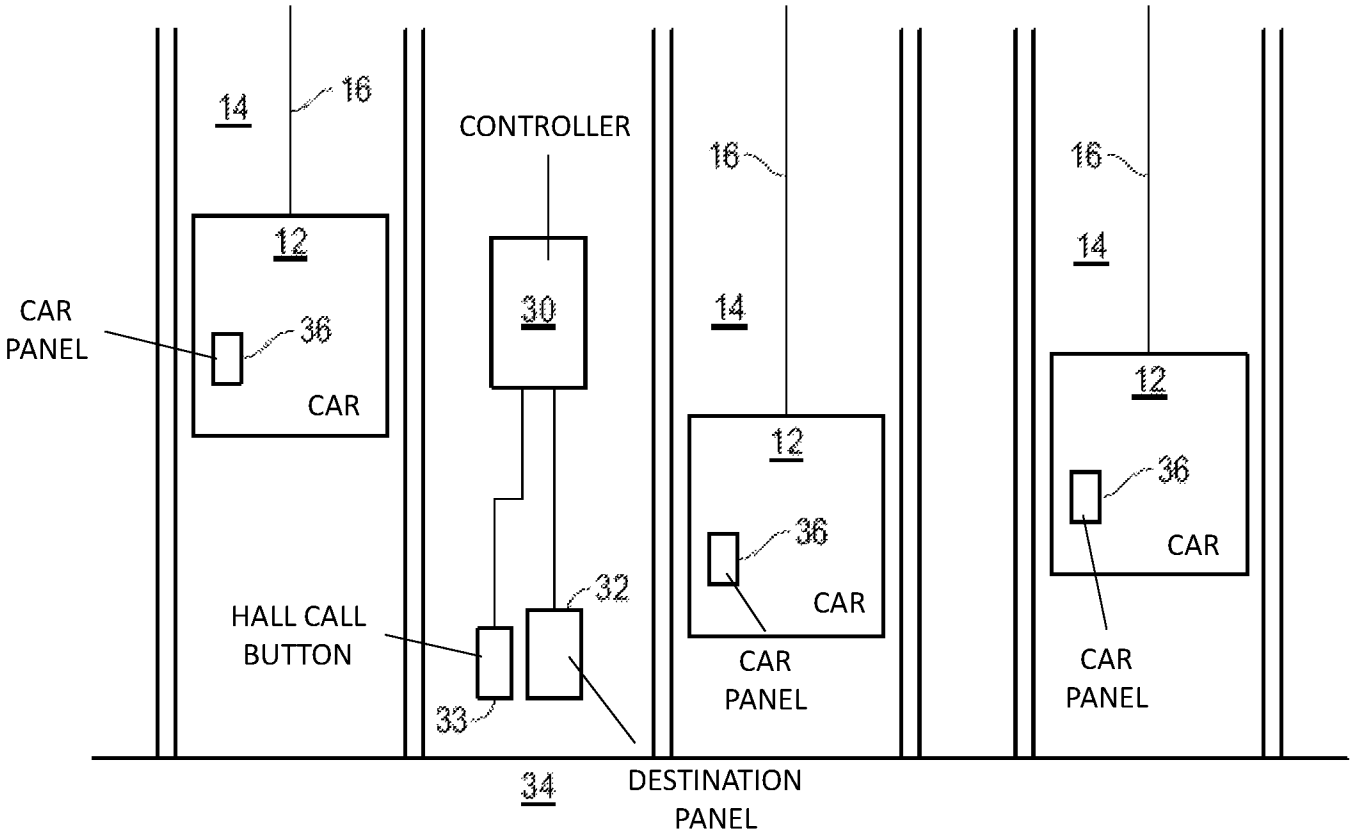
FIG. 2 is an illustration of another embodiment of an elevator system having multiple hoistways.

As shown in FIG. 2, some elevator systems 10 include multiple hoistways 14 and multiple elevator cars 12 controlled via a controller 30, which may operate in either a destination dispatching mode or in a hall call dispatching mode. In hall call dispatching, the passenger initiates a call by pressing a hall call button 33 located in a hallway 34 outside the hoistway 14. Typically, the button pressed will indicate a desired direction of travel (either up or down) of the passenger. Once inside the elevator car 12, the passenger presses a button on a car panel 36 to indicate a destination floor. In destination dispatching, the passenger indicates the destination floor on a destination entry panel 32 in the hallway 34. The controller 30 decides which elevator car 12 the passenger will travel on and directs the passenger to the correct elevator car 12 by, for example, a message on the destination entry panel 32 or an audible signal.

Figure 3:
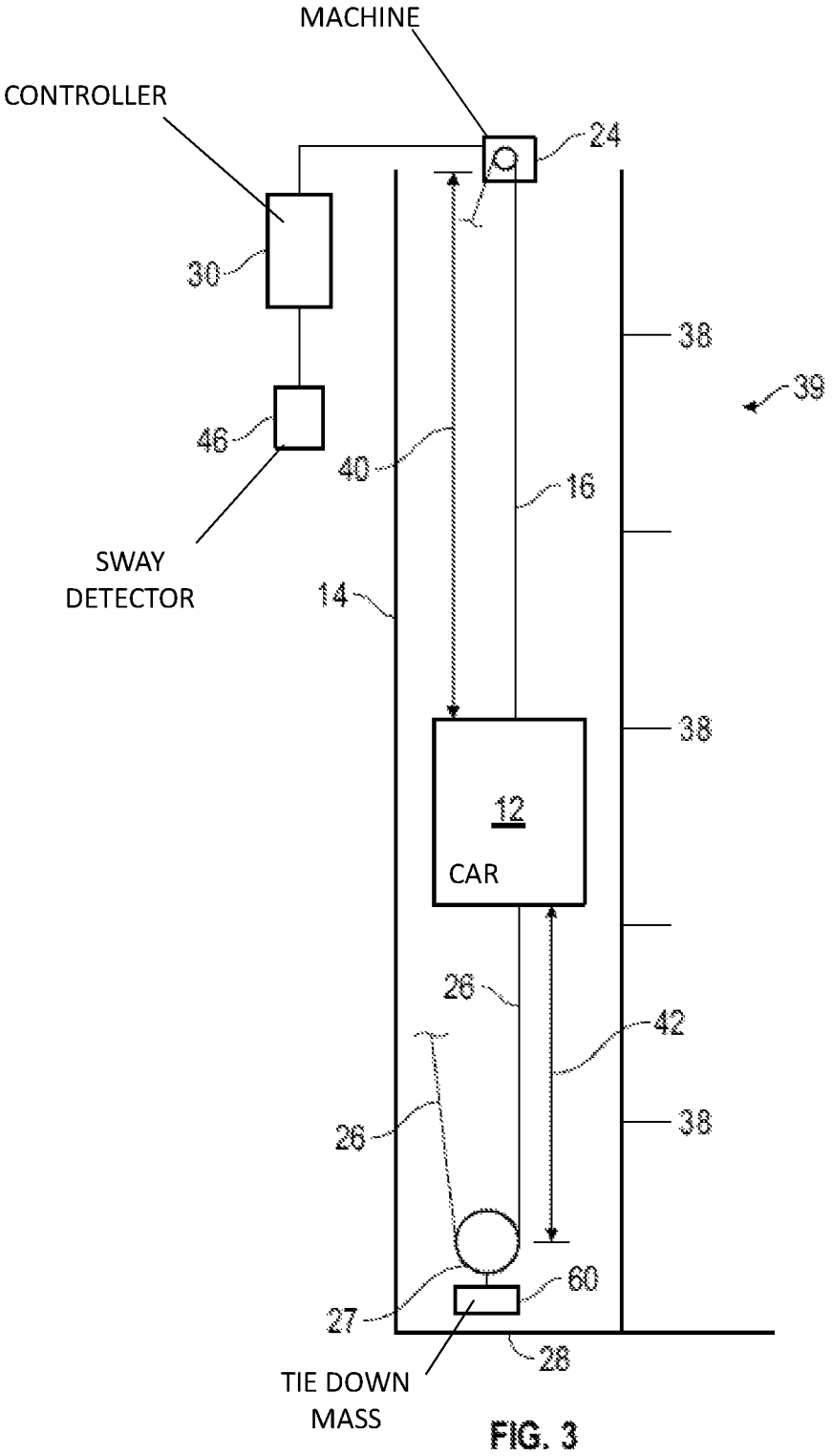
FIG. 3 is an illustration of yet another embodiment of an elevator system.

Referring now to FIG. 3, as the elevator car 12 moves to provide service to various floors 38 of a building 39, a suspension rope length 40 between the machine 24 and the elevator car 12 shortens as the elevator car 12 moves upwardly in the building 39. Similarly, a compensation rope length 42 between the elevator car 12 and the hoistway pit 28 shortens as the elevator car 12 moves downwardly in the building 39. During conditions of building sway, for example, high wind events, the suspension ropes 16 and the compensation ropes 26 will sway laterally at a frequency and amplitude. Quickly shortening suspension ropes 16 or compensation ropes 26 via elevator car 12 travel in the building 39 while the ropes 16 or 26 have significant lateral sway amplitude results in increased rope vibratory frequency that when coupled with vertical motion of the elevator car 12 results in undesirable vertical vibrations and noise in the elevator car 12. Such conditions are most prevalent when the elevator car 12 is making a long, non-stop run in the building 39, for example, when the elevator car 12 is conveying a passenger from a high floor 38 in the building 39 to a first floor 38 of the building 39, with no other calls for the elevator car 12 being made. Conventionally, the elevator car 12 would travel along the hoistway 14 without interruption, resulting in high vibration of the elevator car 12 with the quick shortening of the compensation ropes 26 as the elevator car 12 nears a bottom of the hoistway 14. It is to be appreciated that similar conditions would exist when the elevator car 12 makes a long uninterrupted run in the upward direction in the building 39 and the suspension ropes 16 are quickly shortened.

To mitigate this issue, specific logic is utilized by the controller 30 during building sway condition as detected, for example, by a building sway detector 46. The building sway detector 46 may be a pendulum switch, accelerometer, input from a building tuned mass damper, or a wind anemometer, or other such device. When a building sway is detected, and the elevator car 12 is on a long travel run such as described above, the controller 30 will assign a false call at a floor 38 prior to the elevator car's destination floor 38. For example, during travel from a high floor 38 to the lobby floor 38, the controller 30 may assign a false call to a fifth floor 38, to briefly stop the elevator car 12. If the elevator system includes multiple hoistways 14 and multiple elevator cars 12, the elevator car 12 on the long travel run is assigned priority to accept a request from an intermediate floor 38 to briefly stop the elevator car 12.

The brief stop of the elevator car 12, whether due to the actual intermediate call or the false call allows the rope sway amplitude, either of the suspension ropes 16 or compensation ropes 26, to lessen before the elevator car 12 returns to motion, thus preventing the high amplitude that results in vibration at the elevator car 12 due to the high speed shortening of the ropes. This solution is beneficial as it is only apparent to a passenger as a false call when a low volume of passengers are utilizing the elevator system 10. Further, the elevator cars 12 are not slowed for each trip during a building sway event as is the typical solution, so performance of the elevator system 10 is improved, especially during high volume usage of the elevator system 10.

Figure 4:
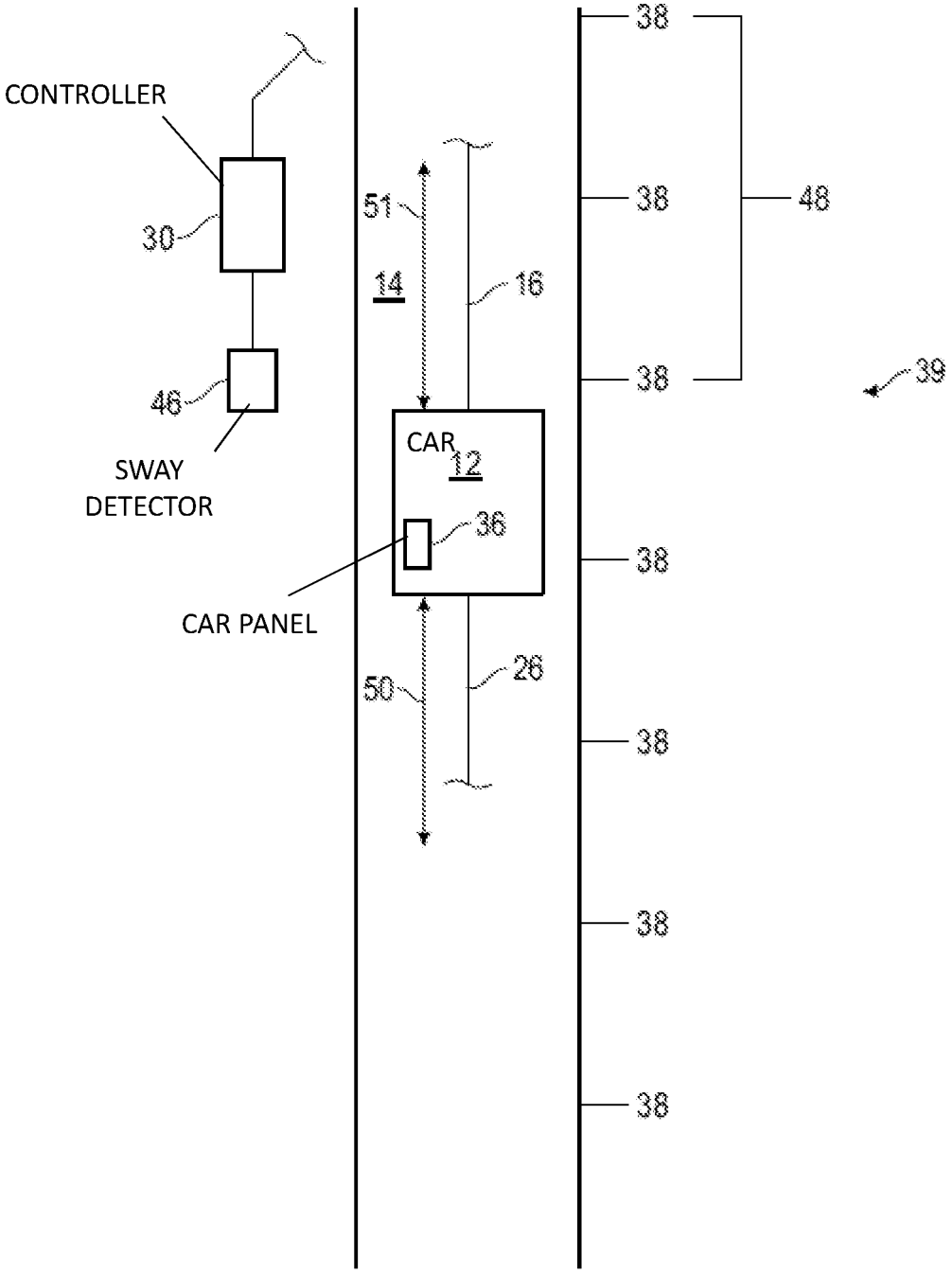
FIG. 4 is an illustration of still another embodiment of an elevator system.

In another embodiment, as illustrated in FIG. 4, during a building sway event, the building 39 has one or more critical zones 48, equating to floors 38 or sets of floors 38. Critical zone landings or floors 38 are vertical stopping locations in the building 39 that set the length of elevator compensation ropes 26 or suspension ropes 16 that result in their resultant natural sway period to be close in magnitude to the building sway periods. At these locations (critical zones) it is very easy to build up large rope sway amplitudes during building sway events. It is to be appreciated that while the description herein is of limiting sway of suspension ropes 16 and compensation ropes 26 at a car 12 side of the elevator 10, the invention described herein may also be applied to limiting sway of suspension ropes 16 and/or compensation ropes 26 at a counterweight 20 side of the elevator 10. In this case the concept of critical zones would be extended to include landings that put the counterweight side hoist ropes 16 or compensation ropes 26 at respective lengths 51 or 50 that result in those rope segments being tuned to be similar to the building sway input period. Time that elevator cars 12 spend in the critical zones 48 increases the likelihood of excessive suspension rope 16 or compensation rope 26 vibration during the building sway event. As such, as part of controller 30 operation during such a sway event, either in a destination dispatch or traditional hall call elevator system 10, the building sway detector 46 triggers the controller 30 to initiate building sway mode. The controller 30 will then limit the number of calls that can be accepted by an individual elevator car 12 for landings in the critical zones 48. Limiting the number of calls that can be accepted in the critical zones 48 limits the amount of time the particular elevator car 12 spends in the critical zone 48, thereby limiting rope sway amplitudes. In addition to limiting the number of calls that can be accepted in a critical zone 48, the controller 30 may choose to adjust the number of stops the elevator car 12 may make in the critical zone 48 depending on how many passengers will be boarding or deboarding the elevator car 12 at a particular floor 38, because the number of passengers boarding or deboarding determines a necessary transfer time at the floor 38 and therefore affects the amount of time spent in the critical zone 48.

Further, the controller 30 may utilize static critical zone 48 determinations input into the controller 30, or may make dynamic adjustment to the critical zone 48 based on information provided to the controller 30. For example, weight of the elevator car 12 has an effect on the suspension ropes 16, so the controller 30 may utilize a dynamic calculation of the critical zone 48 based on a number of passengers in the elevator car 12 and/or a load weight from a load weight cell. In some elevator systems 10, a weight of an empty elevator car 12 may also be used as part of the calculation of the critical zone 48.

In a destination dispatch elevator system 10, the controller 30 monitors the number of stops assigned to a particular elevator car 12 and then limits the number of stops to a number appropriate to an amount of time that can be spent in the critical zone 48. For example, if the critical zone 48 of a particular building 39 is defined by floors 10 through 15 in a building 39 of fifteen floors, then the controller 30 can assign any number of passengers to stop at floors 2 through 9, while only allowing one or two stops in the critical zone 48, floors 10 through 15, in any given run of the elevator car 12. The controller may do this by, for example, allowing only passengers traveling to floor 12, or one of the other floors in critical zone 48, into a particular elevator car 12, while not allowing passengers whose destination is any of the other floors in the critical zone 48 into the same elevator car 12. Alternatively, the controller 30 may allow passengers bound for any of the floors in the critical zone 48 to enter the same elevator car 12, but to direct the elevator car 12 to travel out of the critical zone 48 between stops in the critical zone 48 thereby limiting contiguous time spent in the critical zone 48.

In a traditional hall call elevator system 10, the building sway mode may be implemented by limiting the number of elevator car 12 calls accepted by the car panel 36 in the critical zone 48. For example, in the building 39 with the floor 10 through 15 critical zone 48 above, the controller can effectively lock out the critical zone floor call buttons of the car panel 36 after one or two calls to the critical zone 48 have been registered by the car panel 36. Suppose a number of passengers enter an elevator car 12 at the first floor of building 39, the elevator system 10 having building sway mode engaged so that only one stop is permitted in the critical zone 48. A first passenger depresses the button for floor 12 on the car panel 36. Any attempts to depress buttons for floors 10-11 or 13-15 by the other passengers will not be registered by the car panel 36. The car panel 36 may display a message informing the passengers that it will be necessary to leave the elevator car 12 and board another elevator car 12 to travel to floors 10-11 or 13-15 due to conditions. The displayed message may be augmented by, or replaced by an audible message. Utilizing this building sway mode operation, the elevator system 10 will still be able to service all floors of the building 39, while minimizing time elevator cars 12 spend in the critical zone 48 to reduce the effects of rope sway on elevator car 12 performance.

Figure 5:
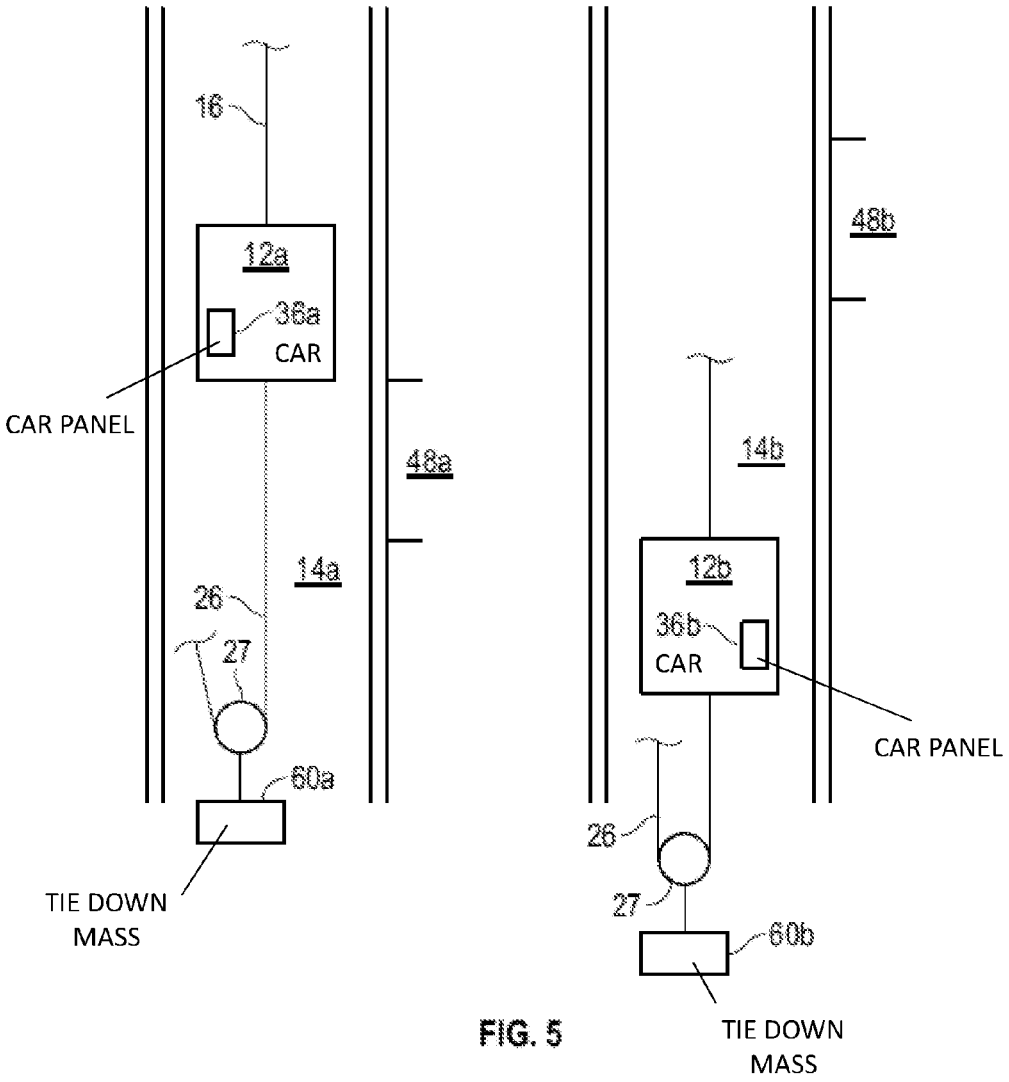
FIG. 5 is an illustration of another embodiment of an elevator system having multiple hoistways.

Referring now to FIG. 5, in other embodiments, an amount of tie down mass 60 may be varied between hoistways 14 in elevator systems 10 with multiple hoistways 14. The effect is that, for example, a critical zone 48*a* for a first hoistway 14*a* having a first tie down mass 60*a* is floors 30-40 of a fifty floor building 39. In a second hoistway 14*b*, a different tie down mass 60*b* is installed, such that a critical zone 48*b* is between floors 40-50. Utilizing a destination dispatch elevator system 10 including the different tie down mass 60*a* and 60*b*, passengers selecting travel to floors 40-50 are assigned to elevator car 12*a* in hoistway 14*a* by the controller 30, while passengers selecting travel to floors 30-40 are assigned to elevator car 12*b* in hoistway 14*b*. In a traditional hall call elevator system 10, the tie down mass variation may be implemented by locking out buttons for floors 30-40 on car panel 36*a* of elevator car 12*a*, and locking out buttons for floors 40-50 on car panel 36*b* of elevator car 12*b*. Passengers pressing the locked out buttons would be directed by a visual and/or audible message to a proper hoistway for their selected floor. Signage may also be installed above the elevator cars 12 to indicate floors 38 of service.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating an elevator system comprising:
- detecting a building sway which causes sway of elevator suspension or compensation members;
- switching an elevator control system into a building sway mode; and
- changing operation of one or more elevator cars of the elevator system via the building sway mode to mitigate vibratory effects of the building sway on the one or more elevator cars, wherein changing operation of one or more elevator cars comprises assigning a false call to an elevator car of the one or more elevator cars to stop the elevator car or giving priority to the elevator car for a call at an intermediate floor to stop the elevator car.

2. The method of claim 1, wherein changing operation of one or more elevator cars comprises:
- stopping an elevator car during travel;
- reducing a sway amplitude of suspension or compensation members operably connected to the elevator car via the stoppage; and
- restarting movement of the elevator car.

3. The method of claim 1, wherein changing operation of the one or more elevator cars comprises limiting a continuous length of time an elevator car may spend at a floor or number of floors defined as a critical zone with regard to suspension or compensation member sway.

4. The method of claim 3, wherein the controller accepts a limited number of stops in the critical zone, directing the elevator car out of and into the critical zone between stops to reduce a continuous amount of time the elevator car spends in the critical zone.

5. A method of operating and elevator system, comprising:
- detecting a building sway which causes sway of elevator suspension or compensation members;
- switching an elevator control system into a building sway mode; and
- changing operation of one or more elevator cars of the elevator system via the building sway mode to mitigate vibratory effects of the building sway on the one or more elevator cars;
- wherein changing operation of the one or more elevator cars comprises limiting a continuous length of time an elevator car may spend at a floor or number of floors defined as a critical zone with regard to suspension or compensation member sway, and further including:
  - configuring individual elevator cars of the elevator system with critical zones at different levels in the building; and
  - utilizing the controller to direct passengers to selected elevator cars such that a destination of each passenger is not within the critical zone for the elevator car to which they are assigned, thereby limiting continuous time of the elevator cars in their respective critical zones.

6. The method of claim 5, wherein the critical zones are configured by installing different tie down mass at each elevator car.

7. The method of claim 5, wherein the controller directs passengers to the selected elevator cars.

8. The method of claim 5, wherein the controller disables selection of floors within the critical zone for the individual elevator car.

* * * * *